US005285703A

United States Patent [19]

Carson

[11] Patent Number: 5,285,703

[45] Date of Patent: Feb. 15, 1994

[54] SPANNER PLIER TOOL

[76] Inventor: Thomas E. Carson, 7855 Jericho Rd., Stevensville, Mich. 49127

[21] Appl. No.: 27,430

[22] Filed: Mar. 8, 1993

[51] Int. Cl.[5] ..... B25B 7/02

[52] U.S. Cl. ..... 81/423; 81/176.1

[58] Field of Search ..... 81/405–407, 81/411, 414, 176.1–176.3, 418–419, 421–423, 424.5, 426.5, 185.1, 186; 269/262, 282

[56] References Cited

U.S. PATENT DOCUMENTS 1,640,883 8/1927 Coleman ..... 81/424.5

*Primary Examiner*—D. S. Meislin

*Attorney, Agent, or Firm*—Leon Gilden

[57] ABSTRACT

Pliers arranged in an adjustable relationship including first and second facing jaw faces are arranged to threadedly receive inserts therewithin, having cylindrical or optional polygonal projections arranged for reception within an associated workpiece. The tool structure is arranged to accommodate plural sets of the projections within the handles for ease of access and use of the organization.

3 Claims, 4 Drawing Sheets

SPANNER PLIER TOOL

BACKGROUND OF THE INVENTION

1. Field of the Invention

The field of invention relates to adjustable plier construction, and more particularly pertains to a new and improved spanner plier tool wherein the same is arranged for directing projections into an associated workpiece in a spanner wrench orientation.

2. Description of the Prior Art

Pliers of various types have been utilized throughout the prior art, wherein U.S. Pat. Nos. 4,316,615; 4,922,770; 4,890,520; and 4,944,204 are examples of prior art plier construction.

The instant invention attempts to overcome deficiencies of the prior art by permitting the use of a plier construction arranged to accommodate inserts for use of the plier construction as a spanner wrench and in this respect, the present invention substantially fulfills this need.

SUMMARY OF THE INVENTION

In view of the foregoing disadvantages inherent in the known types of plier tool structure now present in the prior art, the present invention provides a spanner plier tool wherein the same is arranged to receive various insert sets within confronting and facing tools of the plier construction. As such, the general purpose of the present invention, which will be described subsequently in greater detail, is to provide a new and improved spanner plier tool which has all the advantages of the prior art plier tool apparatus and none of the disadvantages.

To attain this, the present invention provides pliers arranged in an adjustable relationship including first and second facing jaw faces to threadedly receive inserts therewithin, having cylindrical or optional polygonal projections arranged for reception within an associated workpiece. The tool structure is arranged to accommodate plural sets of the projections within the handles for ease of access and use of the organization.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved spanner plier tool which has all the advantages of the prior art plier tool apparatus and none of the disadvantages.

It is another object of the present invention to provide a new and improved spanner plier tool which may be easily and efficiently manufactured and marketed.

It is a further object of the present invention to provide a new and improved spanner plier tool which is of a durable and reliable construction.

An even further object of the present invention is to provide a new and improved spanner plier tool which is susceptible of a low cost of manufacture with regard to both materials and labor, and which accordingly is then susceptible of low prices of sale to the consuming public, thereby making such spanner plier tools economically available to the buying public.

Still yet another object of the present invention is to provide a new and improved spanner plier tool which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
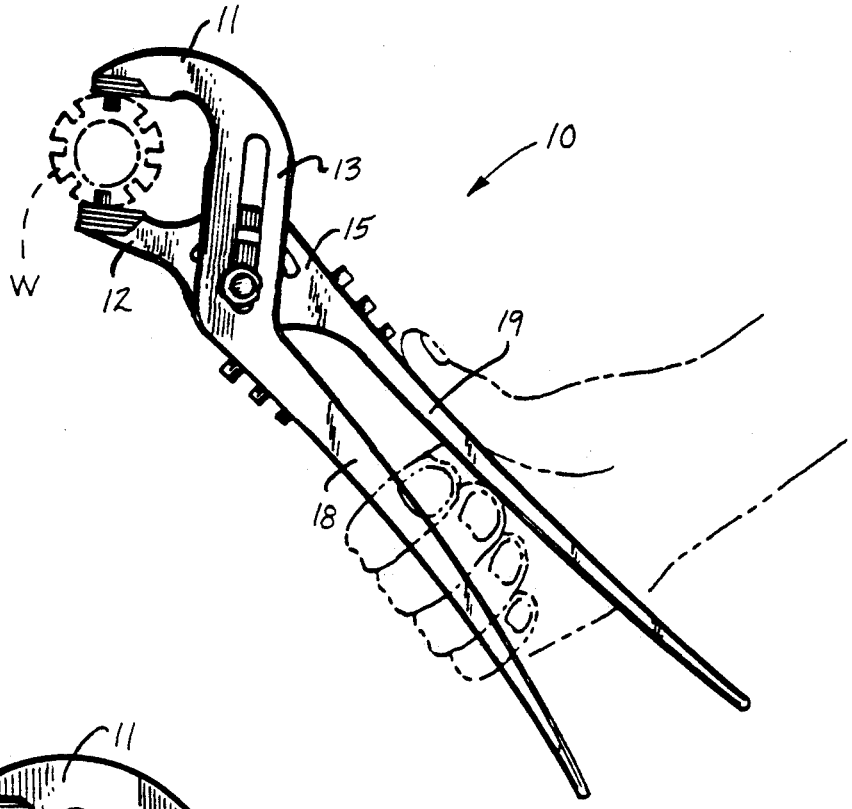
FIG. 1 is an orthographic view of the invention.

With reference now to the drawings, and in particular to FIGS. 1 to 9 thereof, a new and improved spanner plier tool embodying the principles and concepts of the present invention and generally designated by the reference numeral 10 will be described.

More specifically, the spanner plier tool 10 of the instant invention essentially comprises a first rigid jaw 11 spaced from a second rigid jaw 12 in a facing relationship, as the first jaw 11 includes a first jaw shank 13 oriented substantially orthogonally relative to the first jaw 11, having a first jaw slot 14 directed through the first jaw shank. A second jaw shank 15 is arranged in cooperation with the first jaw shank 13, with the second jaw shank 15 having a second jaw arcuate rib 16 arranged for reception with one of a plurality of first jaw arcuate slots 17. A first handle 18 oriented at an obtuse angle relative to the first jaw shank 13 cooperates with a second handle 19 mounted to the second jaw shank 15, wherein a pivot axle 20 directed through the first jaw slot 14 arranged in a pivotal relationship of the first and second jaws relative to one another to secure a workpiece "W" therebetween. The first jaw 11 includes a first jaw planar face 21 arranged in facing confronting relationship relative to a second jaw planar face 22. The first jaw planar face 21 is provided with a first jaw threaded bore 23 orthogonally directed into the first jaw planar face, with a second jaw threaded bore 24 orthogonally directed into the second jaw planar face 22. Respective first and second inserts 25 and 26 respectively, each having a respective threaded shank, are received within respective first and second jaw threaded bores 23 and 24 for use of the inserts and their projection beyond the planar faces of the respective jaw faces 21 and 22 for reception within openings of the workpiece "W" for use of the organization as a spanner wrench.

Figure 2:
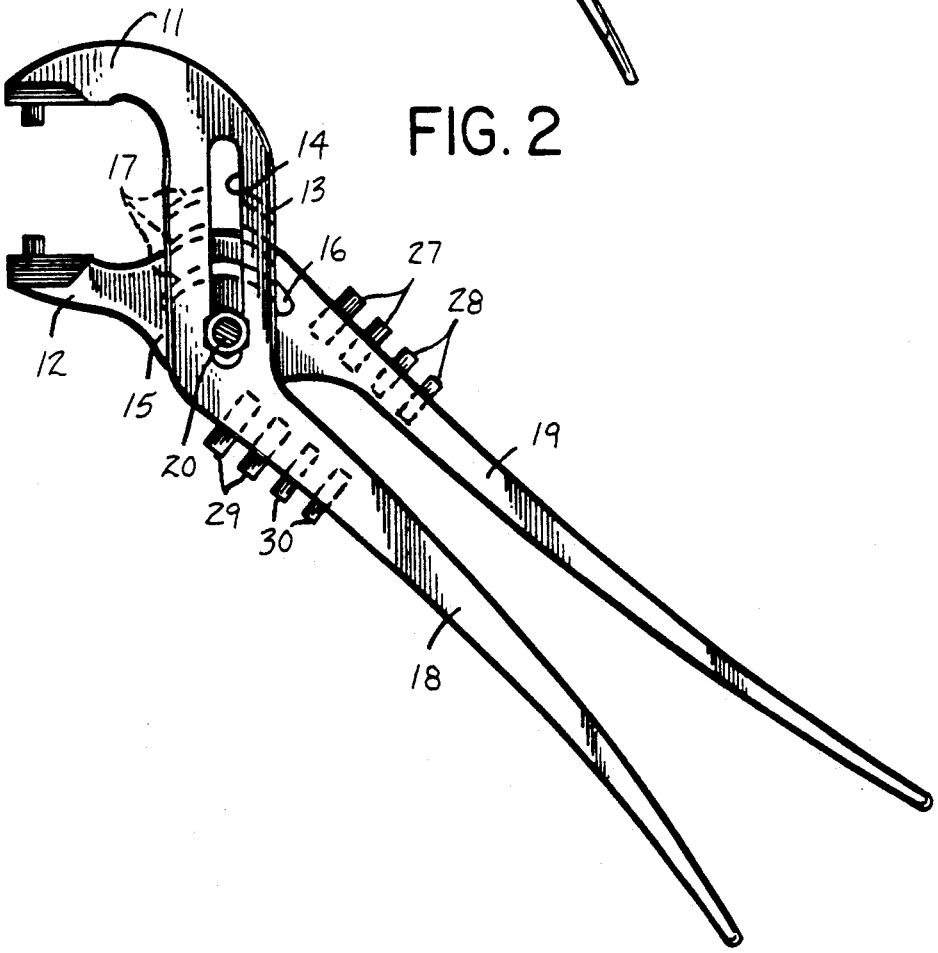
FIG. 2 is an enlarged orthographic view of the invention.
Figure 3:
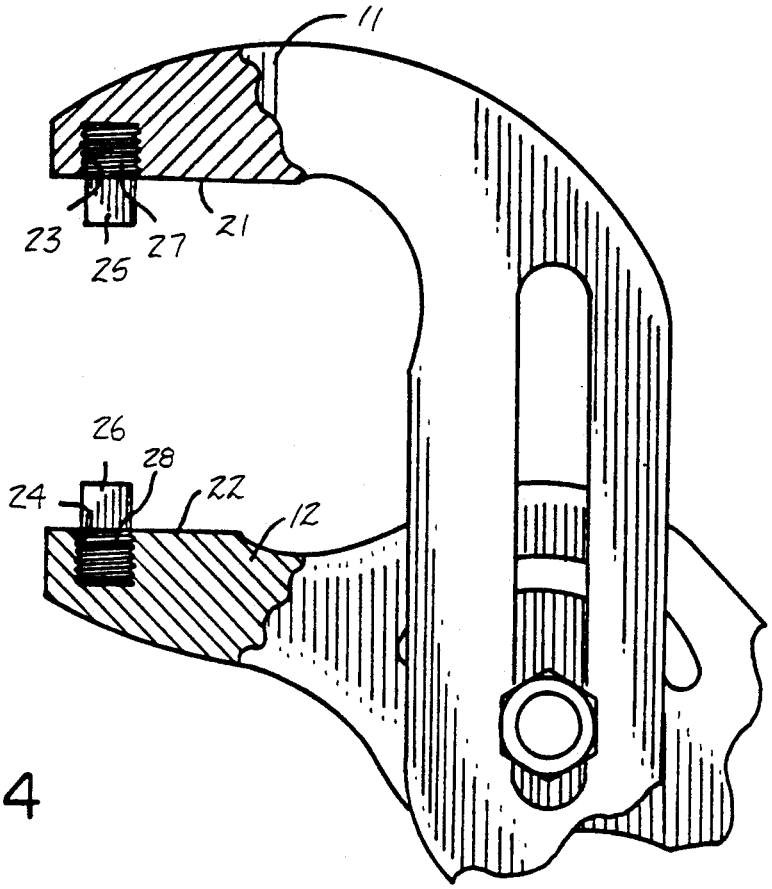
FIG. 3 is an enlarged orthographic view, partially in section, of the facing jaws of the invention.
Figure 4:
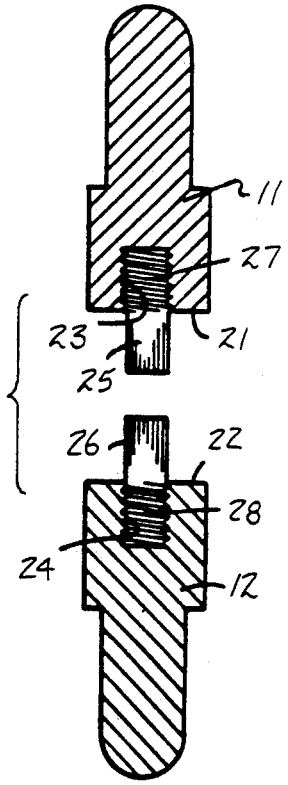
FIG. 4 is an orthographic cross-sectional illustration of the jaws mounting the inserts therewithin.
Figure 5:
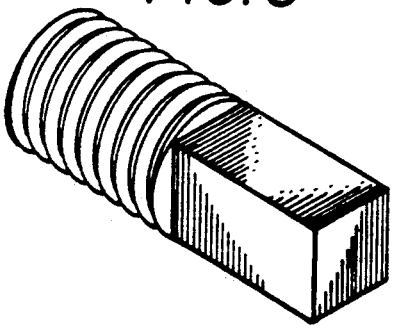
FIG. 5 and FIG. 6 are isometric illustrations of various configurations of inserts arranged for reception within the jaw structure.
Figure 6:
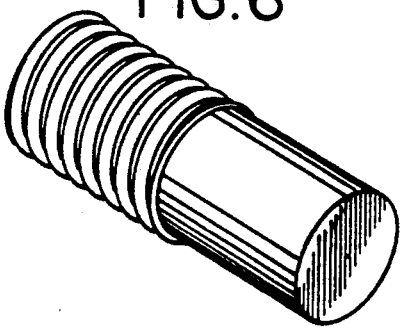
Figure 7:
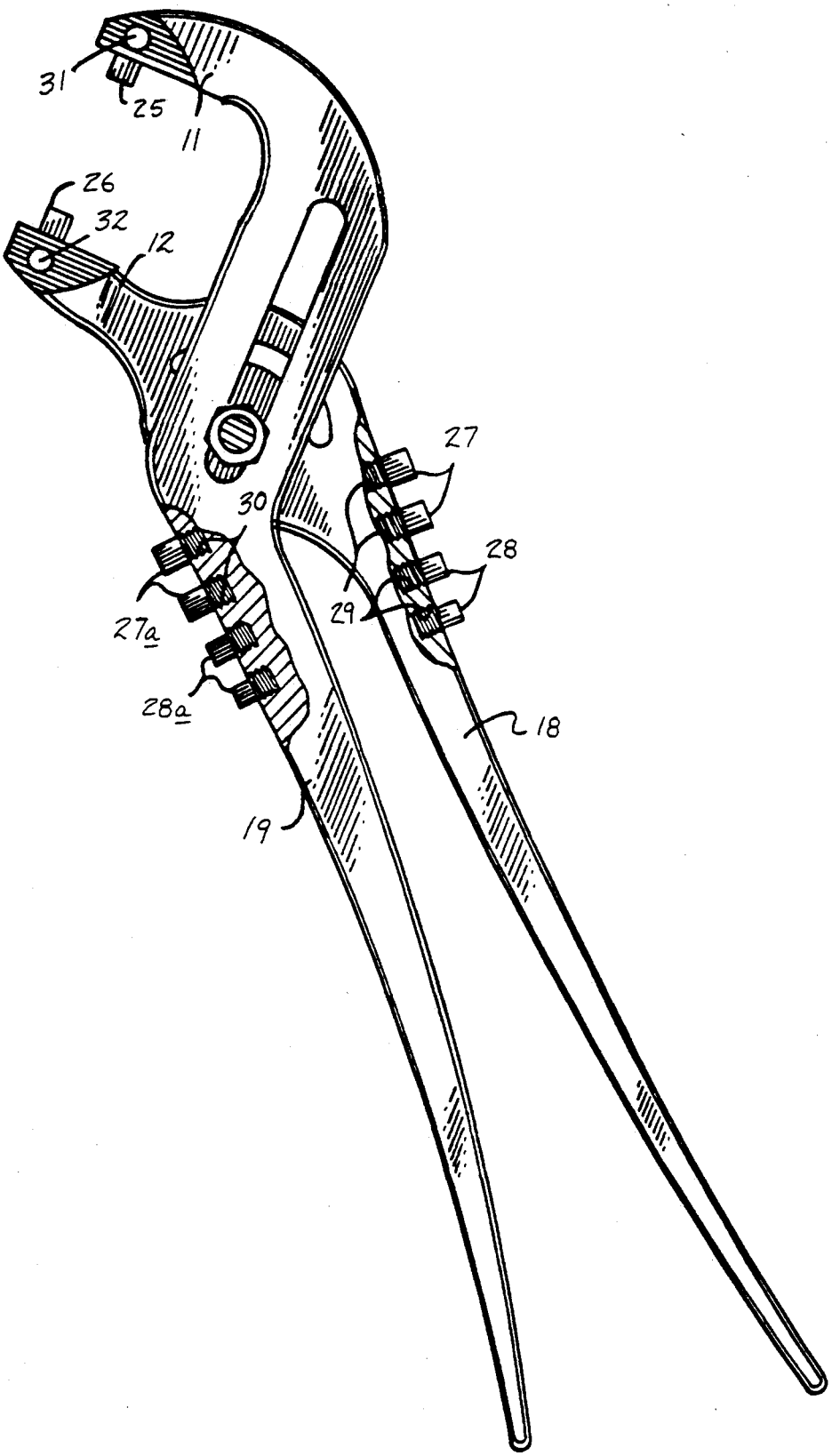
FIG. 7 is an enlarged orthographic view of the inserts mounted within the handle construction in a partially cutaway configuration.

With reference to FIGS. 2 and 7, a plurality of spaced first handle threaded bores 29 are directed into the first handle, wherein second handle threaded bores 30 spaced apart in an elongate row are directed into the second handle, wherein the first handle threaded bores receive respective first and second insert pairs 27 and 28, while the second handle threaded bores 30 receive respective third and fourth insert pairs **27*a* and 28*a*, as indicated in FIG. 7, within the first and second handle threaded bores 29 and 30. In this manner, the insert pairs mounted to the handles, as indicated in FIG. 7, may be substituted for the first and second inserts 25 and 26 to provide for various configurations of projections extending orthogonally beyond respective first and second jaw planar faces 21 and 22**, such as polygonal, ellipsoidal, and the like.

Figure 8:
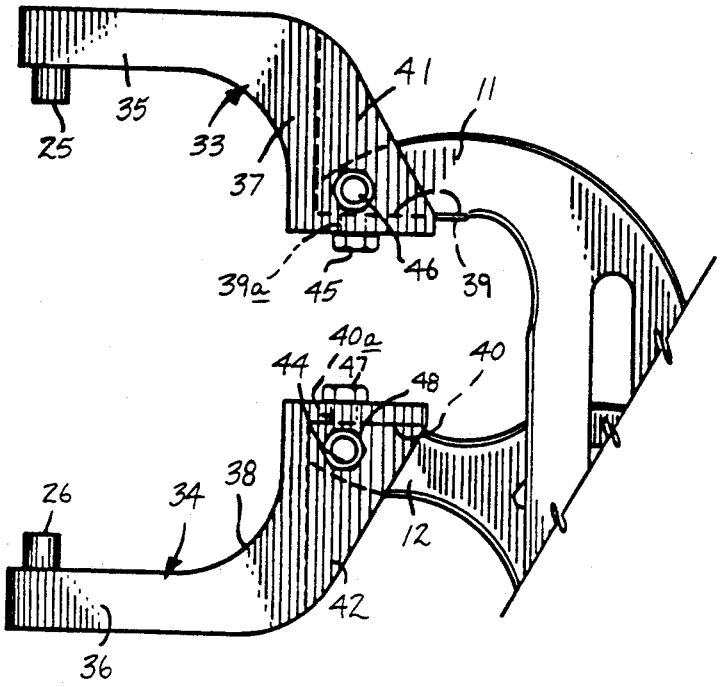
FIG. 8 is an orthographic view in the use of jaw extensions for use by the invention.
Figure 9:
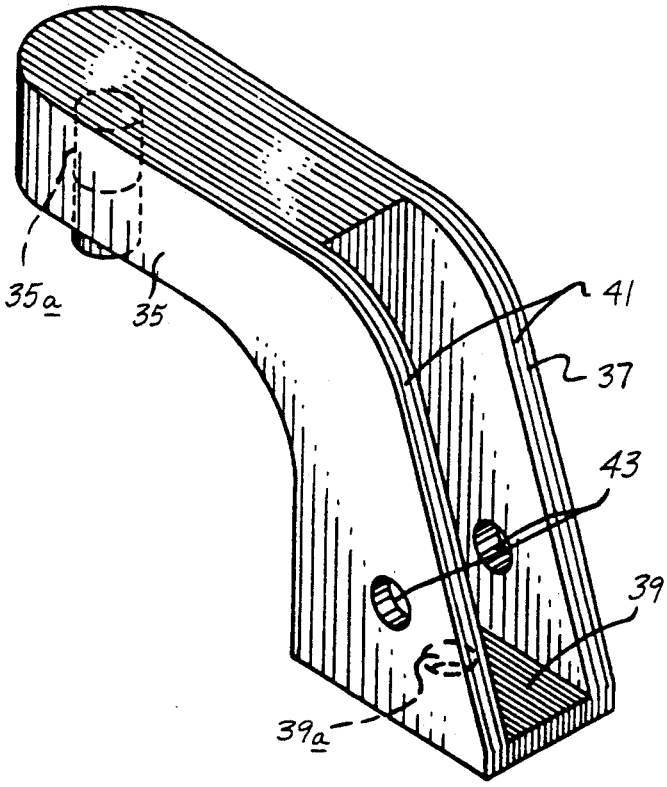
FIG. 9 is an isometric illustration, somewhat enlarged, of one of the jaw extensions for use by the invention.

It should be noted that the FIG. 7 includes a first jaw cross bore 31 orthogonally directed through the first jaw 11 orthogonally oriented relative to the first jaw threaded bore 23 and parallel to the first jaw planar face 21, wherein a second jaw cross bar 32 is orthogonally directed through the second jaw 12 orthogonally oriented relative to the second jaw threaded bore 24 and parallel to the second jaw planar face 22. The first and second jaw cross bores 31 and 32 are arranged for mounting to respective first and second jaw extensions 33 and 34, in a manner as indicated in FIG. 8. The first and second jaw extensions 33 and 34 are arranged in a mirror image configuration relative to one another, and include respective first and second extension jaws 35 and 36 arranged for reception of the first and second inserts 25 and 26 or one of the insert pairs **27–28*a* into associated first and second extension jaw threaded bores, such as bore 35*a* as indicated in FIG. 9. The respective first and second extension jaws 35 and 36 include respective first and second jaw mounting sockets 37 and 38 that are arranged substantially orthogonally relative to the first and second extension jaws 35 and 36 respectively, wherein the first jaw mounting socket 37 includes a first socket floor 39, wherein the second jaw mounting socket 38 includes a second socket floor 40. The first floor 39 is oriented parallel to the first extension jaw 35, wherein the second floor 40 is oriented parallel relative to the second extension jaw 36. The first floor 39 includes a first floor bore 39*a*, wherein the second floor 40 includes a second floor bore 40*a* to receive respective first and third fasteners 45 and 47 respectively to be received within the respective first and second jaw threaded bores 23 and 24. The first mounting socket 37 includes first side walls 41, wherein the second mounting socket 38 includes second side walls 42, as the first side walls 41 receive a second fastener 46 therethrough and through the first jaw cross bore 31, wherein the second side walls 42 include a fourth fastener 48 received through the second side wall bores 44 and into the second jaw cross bore 32 to mount the extension jaws, in a manner as indicated in FIG. 8**, to accommodate enlarged workpieces while maintaining compact configuration of the plier construction.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A spanner plier tool, comprising, a first jaw spaced from a second jaw, the first jaw including a first jaw shank orthogonally and integrally mounted to the first jaw, the second jaw including a second jaw shank in sliding engagement with the first jaw shank, the first jaw shank including an opening and the second jaw shank including a pivot axle received through the opening to permit pivoting of the first jaw relative to the second jaw, wherein the first jaw shank includes a first handle, the second jaw shank having a second handle, wherein the first handle and the second handle extend coextensively relative to one another, the first jaw including a first jaw planar face, the second jaw including a second jaw planar face, the first jaw planar face including a first threaded bore orthogonally directed into the first jaw planar face, and the second jaw including a second jaw threaded bore orthogonally directed into and through the second jaw planar face, and a first insert threadedly received within the first threaded bore, and a second insert received within the second threaded bore, the first insert having a first insert projection extending orthogonally beyond the first jaw planar face, the second insert having a second projection extending orthogonally beyond the second planar face, wherein the first projection and the second projection are arranged for reception within a workpiece, and the first handle includes a row of first handle threaded bores, the second handle having a further row of second handle threaded bores, the first handle threaded bores receiving at least one pair of further inserts threadedly therewithin, and the second handle threaded bores receiving at least one further pair of inserts threadedly received therewithin.

2. A tool as set forth in claim 1 wherein the first jaw includes a first jaw cross bore orthogonally oriented relative to the first jaw threaded bore, the second jaw having a second jaw cross bore orthogonally oriented relative to the second jaw threaded bore, wherein the first jaw cross bore and the second jaw cross bore are respectively parallel relative to the first jaw planar face and the second jaw planar face, and a first jaw extension arranged for securement to the first jaw and a second jaw extension arranged for securement to the second jaw, with the first jaw extension including a first extension jaw and the second jaw extension including a second extension jaw, the first extension jaw including a first jaw mounting socket orthogonally oriented relative to the first extension jaw, the second extension jaw including a second jaw mounting socket orthogonally oriented relative to the second extension jaw, the first jaw mounting socket including a first floor, the second jaw mounting socket including a second floor, the first floor having a first floor bore, the second floor having a second floor bore, and a first fastener arranged for projection through the first floor bore into the first jaw threaded bore, and a second fastener directed through the second floor bore and arranged for reception within the second jaw threaded bore, whereupon the first insert and the second insert respectively are removable from the first jaw threaded bore and the second jaw threaded bore.

3. A tool as set forth in claim 2 wherein the first jaw mounting socket includes first side walls, the second jaw mounting socket includes second side walls, the first side walls including coaxially aligned first side wall bores orthogonally oriented relative to the first floor bore, and a third fastener directed through the first side wall bores and the first jaw cross bore, and the second jaw mounting socket including second side walls having second side wall bores that are coaxially aligned relative to one another and orthogonally oriented relative to the second floor bore, and a fourth fastener directed through the second side wall bores and the second jaw cross bore, and the first extension jaw to threadedly receiving the first insert, and the second extension jaw is threadedly receiving the second insert, with the first insert orthogonally oriented relative to the first extension jaw, and the second insert orthogonally oriented relative to the second extension jaw.

* * * * *